US005258209A

United States Patent [19]

Bankert et al.

[11] Patent Number: 5,258,209

[45] Date of Patent: Nov. 2, 1993

[54] DECORATIVE BELL

[75] Inventors: Richard D. Bankert, Wilmington, Del.; Edward D. Ciuffetelli, Unionville, Pa.; Dante Pro; Jerrold W. Ross, both of Philadelphia, Pa.

[73] Assignee: Franklin Mint Company, Franklin Center, Pa.

[21] Appl. No.: 581,357

[22] Filed: Sep. 12, 1990

[51] Int. Cl.[5] ..... G09F 19/00

[52] U.S. Cl. ..... 428/11; D11/157; 40/406; 40/410; 428/13

[58] Field of Search ..... 40/406, 410; 428/11, 428/13; 446/267; 116/171; D11/157

[56] References Cited

U.S. PATENT DOCUMENTS

| | | | |
|---|---|---|---|
| 308,950 | 12/1884 | Chalvin | 428/13 X |
| 1,648,344 | 11/1927 | Hatcher | 428/13 |
| 2,361,423 | 10/1944 | Snyder | 40/410 |
| 2,435,612 | 2/1948 | Snyder | 40/406 X |
| 2,518,502 | 8/1950 | Snyder | 40/406 X |
| 2,589,757 | 3/1952 | Williams | 446/267 |
| 3,334,899 | 8/1967 | Bosko et al. | 446/267 X |
| 4,186,682 | 2/1980 | Longsdorf et al. | 428/11 X |
| 4,817,311 | 4/1989 | Ong | 40/410 |
| 4,852,283 | 8/1989 | Teng | 428/13 X |

FOREIGN PATENT DOCUMENTS

| | | | |
|---|---|---|---|
| 472258 | 6/1952 | Italy | 40/410 |

*Primary Examiner*—Henry F. Epstein

*Attorney, Agent, or Firm*—Seidel, Gonda, Lavorgna & Monaco

[57] ABSTRACT

The invention is directed to a decorative device for displaying an ornamental object within a fluid. The device takes the form of a transparent hollow bell-shaped enclosure, the interior of the enclosure containing a fluid and a plurality of small particles. A handle is attached to the crown of the enclosure. A fluid tight base is sealingly connected to the mouth of the enclosure. A fluid inlet is positioned within the base for introducing the fluid into the enclosure. A plug seals the fluid inlets to prevent fluid from leaving the enclosure. A bottom cover is placed over the base to provide a flat surface to permit the device to stand in an upright position on a horizontal surface.

15 Claims, 4 Drawing Sheets

FIG. 1
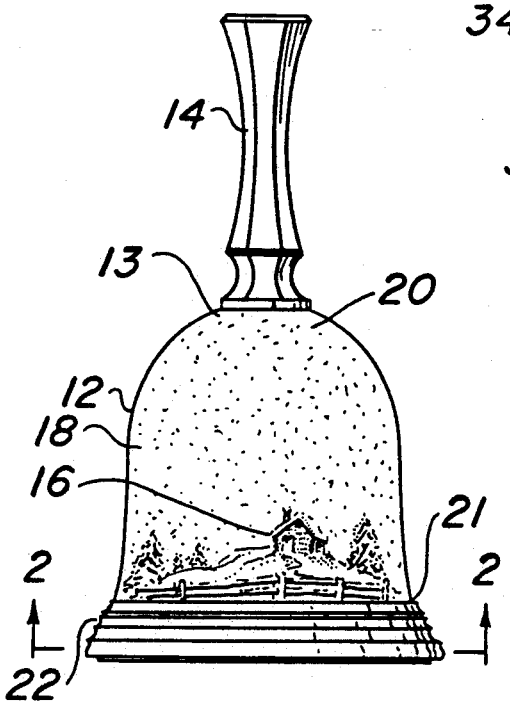
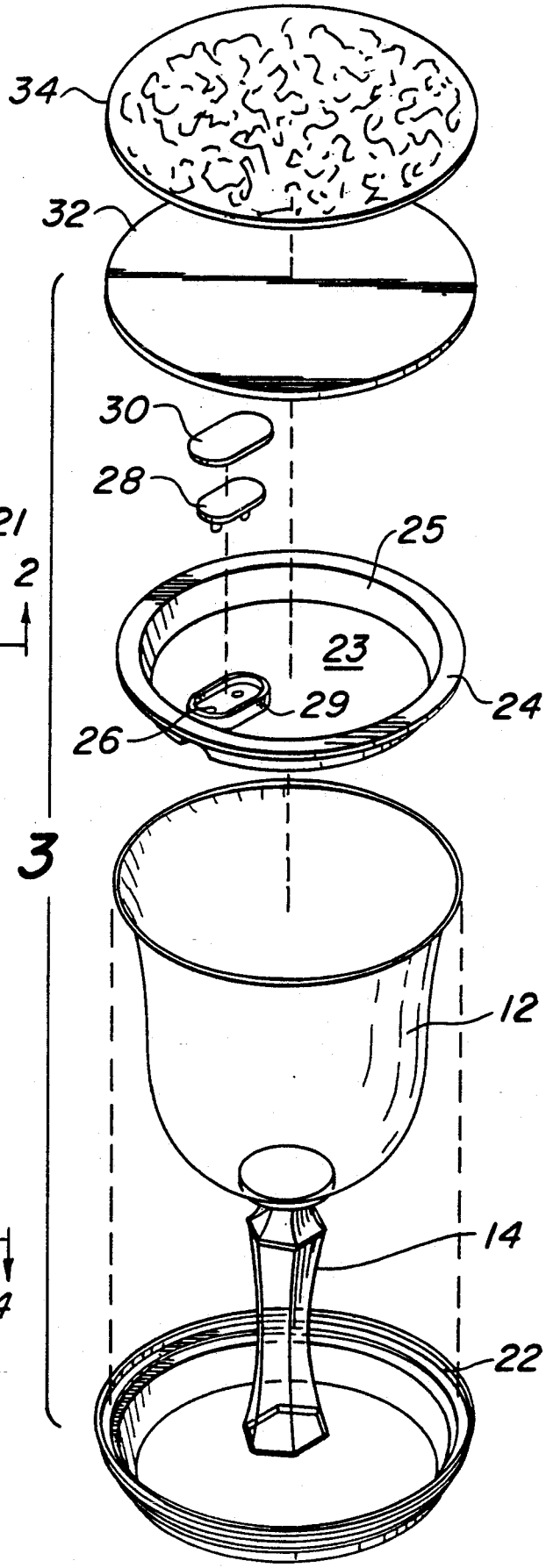
FIG. 3
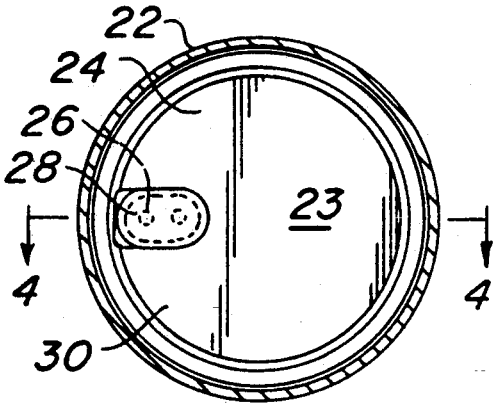
FIG. 2

FIG. 6
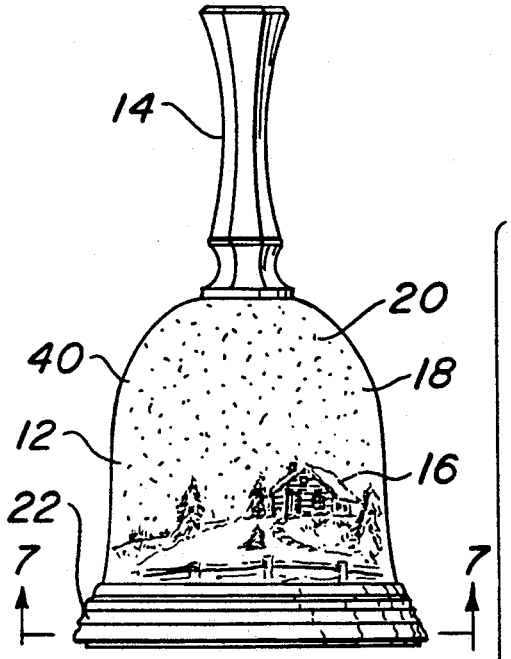
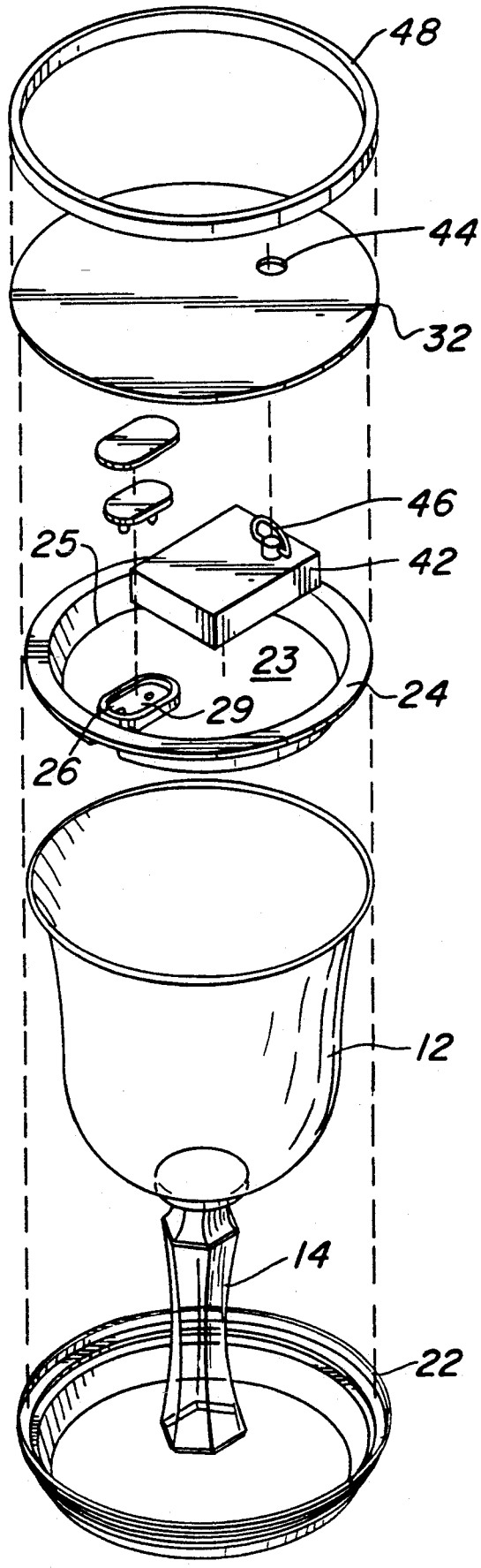
FIG. 8
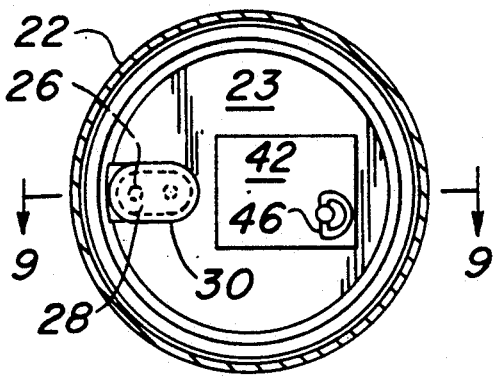
FIG. 7

DECORATIVE BELL

FIELD OF THE INVENTION

This invention is directed to a decorative device, and more particularly to a transparent hollow decorative device for displaying a figure in a fluid therein.

BACKGROUND OF THE INVENTION

Prior art decorative devices having a chamber which include a multiplicity of particles in a fluid in the chamber are known. When the devices are shaken, the particles disperse and become briefly suspended in the fluid so as to augment a scene or graphic presentation inside the enclosure. Usually the particles represent snow while the graphic scene includes various figures or winter scenes. As the suspended particles settle to the base of the enclosure, the scene changes from a blizzard effect to an unclouded scene. The enclosure is normally spherical or hemispherical and transparent so that the entire scene is available to an observer's view. Such prior art devices, due to the shape of their enclosures, are cumbersome to handle.

Other prior art devices are known which use fluids of different specific gravities to produce a multilayer effect. By dyeing each fluid a different color, a unique pattern can be produced in the device. A variation of this type of device is one which uses a fluid and beads of the same specific gravity as the fluid so that the beads are continually suspended in the fluid.

Another type of known decorative device is one in which preserved flowers are immersed in a fluid medium and encased in a transparent enclosure. The flowers are clamped to the base of the device.

Another type of known device is one which is a hollow exerciser shaped like a bar bell. Two hollow spherical transparent containers are connected to either side of a rod and filled with a liquid. Figures and small particles can be placed in the hollow spheres to create graphic scenes.

SUMMARY OF THE INVENTION

The present invention provides a novel decorative device for displaying a figure, and comprises a transparent bell-shaped enclosure. The interior of said enclosure contains a fluid and a plurality of small particles. A handle integrally connected to the crown of said enclosure is provided, and a bezel surrounds the lip of said enclosure. A fluid tight base is sealingly located in the mouth of said enclosure. Fluid inlet means are located in said base for introducing said fluid into said enclosure. A plug means is provided for sealing said fluid inlet means.

A second embodiment of the present invention includes a wind-up music box movement positioned between the base and a bottom cover which provides a level surface when the device is in an upright position. An opening is made in the bottom cover so that the key of the music box is accessible to a user of the device. A ring retains the bottom cover on the base.

A third embodiment provides a method for making the decorative device which incorporates the features described above. A multitude of particles are inserted into the decorative device. The fluid is inserted through the fluid inlet means until the enclosure is full. The fluid and figure inserted in the enclosure are treated so that air is removed from the fluid, and from the figure if necessary. The plug is inserted in the fluid inlet means and the bottom cover is placed over the base.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 1 is an elevational view of a decorative device in accordance with the present invention.

FIG. 2 is a transverse-sectional view taken through line 2—2 of FIG. 1.

FIG. 3 is an exploded view of a device in accordance with the present invention.

FIG. 6 is side elevational view of a second embodiment of a device in accordance with the present invention.

FIG. 7 is a transverse sectional view taken through line 7—7 of FIG. 6.

FIG. 8 is an exploded view of the second embodiment of a device in accordance with the present invention.

DESCRIPTION OF THE PREFERRED EMBODIMENT

Figure 5:
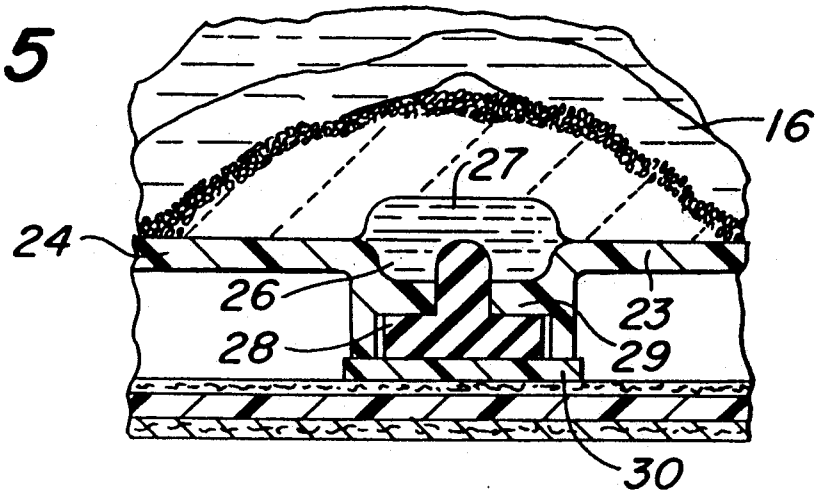
FIG. 5 is an enlarged partial sectional view taken through line 5—5 of FIG. 4.

Referring now to the drawings, with particular reference to FIGS. 1-5, there is shown a decorative device 10 in accordance with the present invention. The device comprises a hollow transparent bell-shaped enclosure 12, preferably made of crystal, but which can be made from any suitable transparent material, such as, but not limited to, glass or plastics. A handle 14 is attached to the crown 13 of the enclosure 12. The handle 14 and enclosure 12 are preferably formed from the same piece of crystal to form an integral unit. The handle 14 can also be a separate unit attached to the enclosure 12 and made of any decorative material such as, but not limited to, precious or semiprecious metal, porcelain or wood. Inside the enclosure is an ornamental object 16, such as, but not limited to, a small statuette or scene, and which is preferably three-dimensional. The object 16 is surrounded by a fluid 18 containing a multiplicity of particles 20 which are capable of being individually floatingly suspended in the fluid 18 when the device 10 is agitated. The fluid 18 contained within the enclosure 12 is preferably a fluid having antifreeze characteristics along with an antibacterial agent. The fluid is preferably water or water and 15-50% by volume of propylene glycol. The antibacterial agent is preferably 0.1 wt % methyl parahydroxybenzoate. The particles 20 suspended in the fluid 18 are preferably made from polystyrene. Surrounding the lip 21 of the enclosure 12 is an ornamental bezel 22, as seen more clearly in FIGS. 3 and 4. The bezel 22 can be made of any decorative material such as, but not limited to, precious or semiprecious metal, porcelain or wood.

Referring to FIGS. 2-5, a base 24 is sealingly connected to the mouth of the enclosure 12, such as by an adhesive, to form a fluid-tight connection. The base 24 is in the form of an inverted shallow plate having a generally flat surface 23 to which the ornamental object 16 is affixed, and a circumferential side wall 25 adjacent the inner surface of the enclosure 12. Any method of sealingly connecting base 24 to enclosure 12 may be used, although an adhesive is preferred. The adhesive can be any type of water resistant adhesive. Base 24 is provided with a fluid inlet means 26 preferably in the form of two holes for introducing the fluid 18 into the enclosure 12. Fluid inlet means 26 is sealed by a plug means 28, preferably although not necessarily made out of hard rubber. A plug cover 30 is placed over the plug 28 to keep the plug in place and further prevent leakage of fluid from the enclosure 12.

Figure 4:
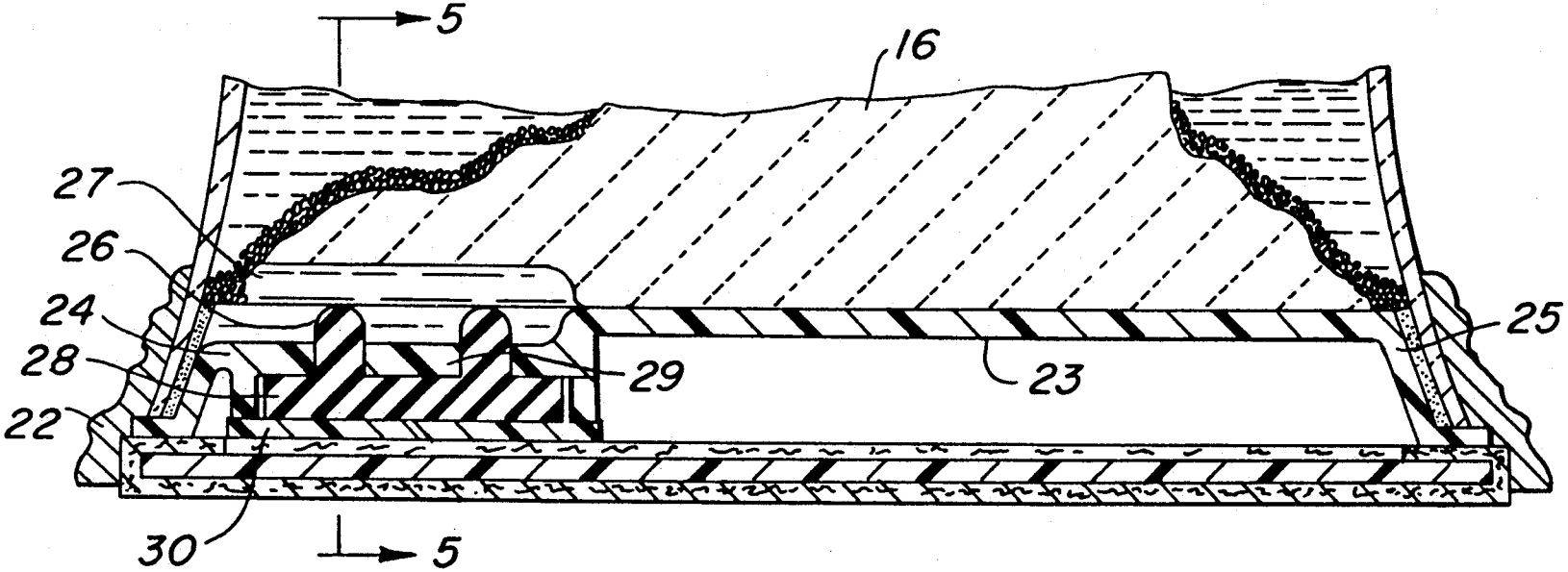
FIG. 4 is an enlarged partial longitudinal sectional view through line 4—4 of FIG. 2.

The fluid inlet means 26 preferably has a generally flat surface 29, which is generally parallel to and offset with respect to surface 23 of base 24, as best seen in FIGS. 4 and 5. A recess 27 is provided on the bottom surface of object 16, juxtaposed to fluid inlet means 26. This forms a plenum between the fluid inlet means 26 and the ornamental object 16 to trap any air bubbles that may be present in the enclosure during filling, as will be described below.

A bottom cover 32 is placed over the base 24 to provide the device 10 with a continuous flat bottom surface. A felt cover 34 is adhered to the bottom surface of the bottom cover 32 and preferably folded over the edge of the bottom cover 32 to securely retain felt cover 34. See FIG. 4. The portion of felt cover 34 which is folded over the edge of bottom cover 32 is thus snugly sandwiched between the edge of cover 32 and the inner surface of bezel 22. If desired, adhesive may be used between bezel 22 and the felt and the edge of bottom cover 32 to prevent the felt cover 34 from peeling away. The felt cover 34 also provides the bottom of the device 10 with a non-abrasive surface. The bottom cover 32 and felt cover 34 are attached to the mouth of the enclosure 12 by any suitable means such as, but not limited to, an adhesive or by friction fit.

A second embodiment of the present invention, which is musically as well as visually attractive, is illustrated in FIGS. 6–10, wherein like reference numerals indicate like parts common to the two embodiments. The structure of the decorative device 40 is substantially similar to that of the first embodiment of device 10. The device 40 comprises a transparent hollow bell-shaped enclosure 12 having a handle attached to the crown of the enclosure 12. An ornamental bezel 22 surrounds the lip of the enclosure. A base 24 is sealingly connected to the mouth of the enclosure. The base 24 is in the shape of an inverted plate having a circumferential side wall 25. Fluid inlet means 26 are located in the base 24 for introducing fluid into the enclosure 12. The fluid inlet means is sealed by a plug 28. A plug cover 30 covers the plug means 28 to further prevent leakage of fluid, all substantially as described previously.

Figure 10:
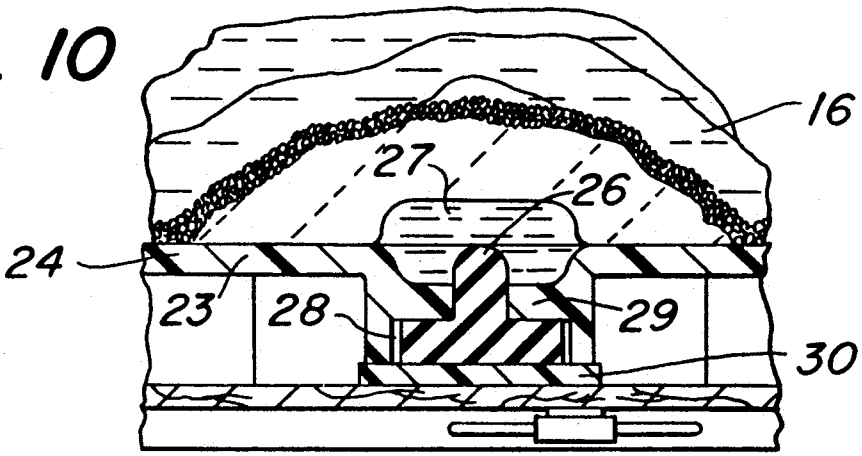
FIG. 10 is an enlarged partial sectional view taken through line 10—10 of FIG. 9.
Figure 9:
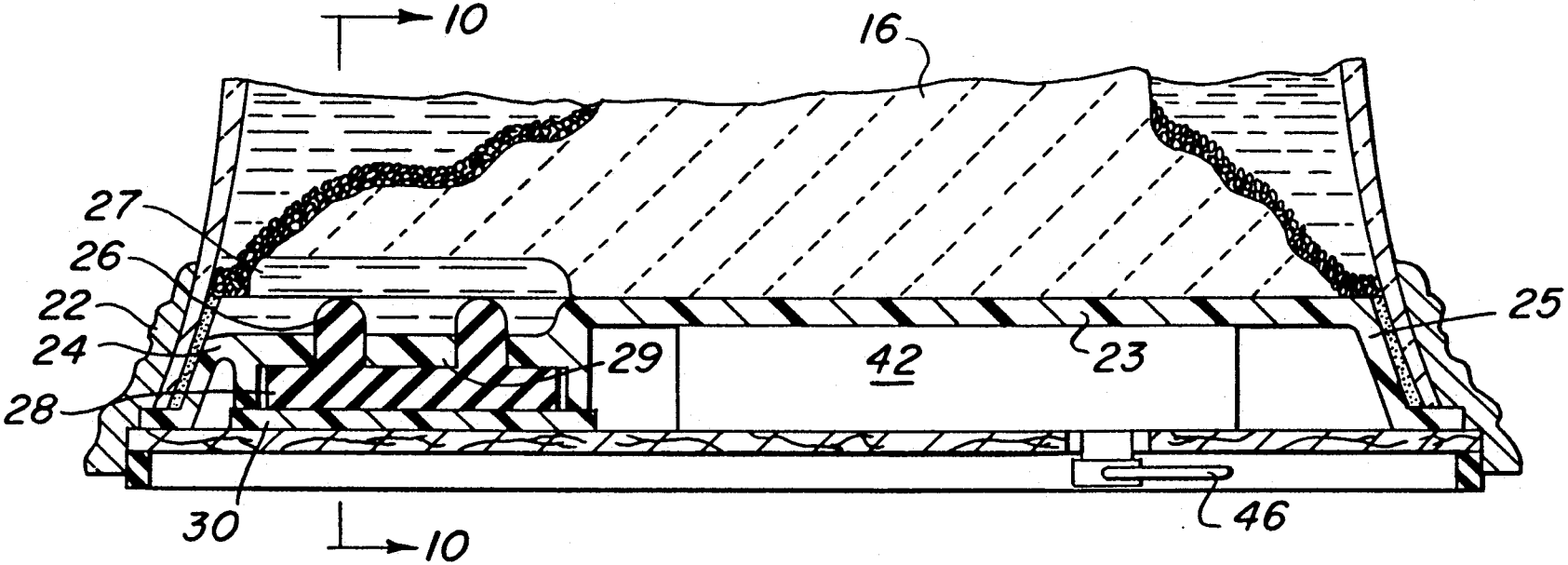
FIG. 9 is an enlarged partial longitudinal sectional view taken through line 9—9 of FIG. 7.

Referring to FIGS. 9 and 10, located between the base 24 and the bottom cover 32 is a wind up music box movement 42. The side wall 25 of the base 24 must be high enough to receive the music box 42 and the associated key 46. An opening 44 is provided in the bottom cover 32 so that the handle of the key 46 of the music box movement 42 is accessible. A retaining ring 48 is attached to the bottom cover 44 and located adjacent the inner surface of the bezel 22. The thickness, or height, of ring 48 is sufficient to provide clearance beneath device 40 for the handle of key 46 when folded flat against the surface of bottom cover 44. Thus, device 40 will be able to stand flat when in an upright position on a horizontal surface. The ring 48 can be attached to the device 10 by any suitable means such as, but not limited to, friction fit or an adhesive.

Decorative devices 10 and 40 are preferably assembled in the following manner. The device 10 is naturally inverted, so that the bottom is uppermost. A multitude of particles 20 are inserted into the device through the fluid inlet means 26 into the enclosure 12. A fluid, treated as described below to remove air bubbles, is then introduced into enclosure 12 through one of the holes of the fluid inlet means 26. The other hole allows air displaced by the fluid to escape. The fluid preferably has antifreeze characteristics, and also preferably contains an antibacterial agent. The fluid is preferably water or water and 15–50% by volume of propylene glycol. The antibacterial agent is preferably 0.1 wt. % methyl parahydroxybenzoate. The fluid 18 can be treated to remove bubbles by boiling the fluid so as to remove any residual gases. Boiling also has the added advantage of sterilizing the fluid. A second method of treating the fluid is by subjecting the fluid 18 to a vacuum to remove any gases present prior to introducing the fluid into enclosure 12. The treated fluid 18 is then introduced into enclosure 12 through one of the holes of the fluid inlet means 26 until the bell-shaped enclosure 12 is filled. The plenum 27 formed adjacent the fluid inlet means 26 acts as a bubble trap to remove any air bubbles that may be present in the enclosure 12 as a result of the filling process. Any air bubbles in the inverted device rise and make their way to the plenum 27 where they are trapped. The trapped bubbles are forced out of exits the device through the other hole of the fluid inlet means 26. The plenum 27 thus allows the bell-shaped enclosure to become completely filled with fluid, with substantially no entrapped air.

Once the enclosure is filled, plug 28 and plug cover 30 are put in place to seal the fluid inlet means 26 retain the fluid 18 in the enclosure 12. It is important to make sure that no air remains in the enclosure or plenum prior to placing the plug 28 over the fluid inlet means 26.

The present invention may be embodied in other specific forms without departing from the spirit or essential attributes thereof and, accordingly, reference should be made to the appended claims, rather than to the foregoing specification, as indicating the scope of the invention.

What is claimed is:

1. A decorative device for displaying an ornamental object comprising:

a transparent hollow bell-shaped enclosure, the interior of said enclosure containing an ornamental object, a fluid and a plurality of small particles individually suspendable in the fluid when the device is physically agitated;

an ornamental handle attached to the crown of said enclosure, the handle being sealed against fluid communication with the interior of the enclosure;

an ornamental bezel surrounding the lip of said enclosure;

a fluid-tight base sealingly engaging the mouth of said enclosure, said base having a circumferential side wall and a generally planar surface facing the interior of the enclosure;

a fluid inlet means in said base for introducing said fluid into said enclosure;

said ornamental object having a surface generally parallel and opposed to the surface of the base facing the interior of the enclosure, and having a space between at least a portion of said ornamental object surface and said planar surface, said space being in communication with said fluid inlet means and defining a plenum between said surface and the fluid inlet means for trapping therein any bubbles of gas present in said fluid and causing said bubbles to be expelled from the enclosure through said fluid inlet means; and a plug means for sealing said fluid inlet means.

2. A decorative device according to claim 1 wherein said handle and said enclosure are integrally formed.

3. A decorative device according to claim 2, wherein the handle and enclosure are made of crystal.

4. A decorative device according to claim 1 wherein said fluid has antifreeze characteristics.

5. A decorative device according to claim 4, wherein the fluid includes an antibacterial agent.

6. A decorative device according to claim 5 wherein said fluid is water and 15–50% by volume of propylene glycol and 0.1 wt % methyl parahydroxybenzoate.

7. A decorative device according to claim 5 wherein said fluid is water and 0.1 wt. % methyl parahydroxybenzoate.

8. A decorative device according to claim 1 wherein said small particles are made from polystyrene.

9. A decorative device according to claim 1 further comprising a bottom cover overlying said base.

10. A decorative device for displaying an ornamental object comprising:

a transparent hollow bell-shaped enclosure, the interior of said enclosure containing an ornamental object, a fluid and a plurality of individually suspendable small particles;

a handle attached to the crown of said enclosure, the handle being sealed against fluid communication with the interior of the enclosure;

an ornamental bezel positioned around the lip of said enclosure;

a fluid-tight base having a circumferential side wall sealingly connected to the mouth of said enclosure and having a generally planar surface facing the interior of the enclosure;

fluid inlet means in said base for introducing said fluid into said enclosure;

said ornamental object having a surface generally parallel and opposed to the surface of the base facing the interior of the enclosure, and having a space between at least a portion of said ornamental object surface and said planar surface, said space being in communication with said fluid inlet means and defining a plenum between said surface and the fluid inlet means for trapping therein any bubbles of gas present in said fluid and causing said bubbles to be expelled from the enclosure through said fluid inlet means;

plug means for sealing said fluid inlet means;

a wind-up music box positioned beneath said base;

a bottom cover enclosing said music box between said base and said cover, said cover attached to said side wall of said base and having an opening for receiving the handle of the key of said music box; and a ring attached to said bottom cover for supporting the device in an upright position.

11. A decorative device according to claim 10 wherein said enclosure and said handle are integrally formed.

12. A decorative device according to claim 10 wherein said fluid is water and 0.1 wt % methyl parahydroxybenzoate.

13. A decorative device according to claim 10 wherein said fluid medium is water, 15–50% by volume propylene glycol and 0.1 wt % methyl parahydroxybenzoate.

14. A decorative device according to claim 10 wherein said particles are made of polystyrene.

15. A decorative device according to claim 10, wherein the handle and enclosure are made of crystal.

* * * * *